United States Patent [19]

Banford

[11] 4,294,023

[45] Oct. 13, 1981

[54] ATHLETIC FOOTWEAR FOR NON-CONTACT OR LIGHT CONTACT SPORTS

[76] Inventor: Samuel E. Banford, 5226 Akron St., Philadelphia, Pa. 19124

[21] Appl. No.: 67,198

[22] Filed: Aug. 16, 1979

[51] Int. Cl.[3] ..... A43B 3/12; A43B 11/00

[52] U.S. Cl. ..... 36/11.5; 36/50; 36/113

[58] Field of Search ..... 36/11.5, 114, 106, 50, 36/129, 113, 97, 112, 8.2

[56] References Cited

U.S. PATENT DOCUMENTS

| | | | |
|---|---|---|---|
| 2,169,337 | 8/1939 | Davis | 36/11.5 |
| 2,220,534 | 11/1940 | McLean | 36/11.5 |
| 2,391,720 | 12/1945 | Ludwig | 36/11.5 |
| 2,536,723 | 1/1951 | Carpenter | 36/11.5 |
| 4,053,995 | 10/1977 | Shein | 36/30 R |
| 4,069,601 | 1/1978 | Robbins et al. | 36/30 R |
| 4,101,704 | 7/1978 | Hiles | 36/30 R |

*Primary Examiner*—Patrick D. Lawson
*Attorney, Agent, or Firm*—Robert J. Zinn

[57] ABSTRACT

Athletic footwear for non-contact or light-contact sports having a resilient sole portion to which front and rear upper portions of reinforced canvas or rubber material are securely attached. Foot protection and mobility are optimized by isolating the plural upper portions, one from the other, and by positioning the front and rear upper portions so as to be effective at points of maximum foot flexibility, namely, over the ball of the foot and across the ankle. Leather reinforcement of the canvas portions at both the bosses through which laces are passed for drawing the shoe to the wearer's foot and at the exposed edges of the canvas uppers prevents discomfort to a sockless user while permitting maximum absorption of stress at these points.

4 Claims, 4 Drawing Figures

ATHLETIC FOOTWEAR FOR NON-CONTACT OR LIGHT CONTACT SPORTS

BACKGROUND OF THE INVENTION

My invention concerns lightweight athletic footwear particularly adapted to non-contact sports or light-contact sports. Thus, a primary design criteria of the footwear is that it enables the wearer to optimize the agility of his feet by providing selective and independent reinforcement to the muscles of the feet without adding undue weight or restriction. Of somewhat lesser significance is the provision of protection to the wearer against natural obstacles including those posed by surface conditions and other players.

Historically, athletic footwear has reflected the designers intention to protect the wearer's foot from nature and his adversary. Thus, a commonality of design and a similarity of construction features have in the past characterized athletic footwear independent of the nature of the sport for which its use was intended. Only in the last few decades has there been a distinct trend toward tailoring athletic footwear to suit the conditions of the sport for which the shoe was to be worn. Nevertheless, the conventional approach is still to start with the basic "protective" shoe construction and modify it to better meet the demands of a particular sport.

In contrast, my approach to the design of athletic footwear for non-contact or light-contact sports has been to maximize agility and maneuverability while at the same time providing the necessary protection to the user's foot which he might naturally be exposed to while engaging in such activity. This novel approach to footwear design reflects itself principally in the "upper" portions of the footwear with only minor modifications being made to the design of a conventional sole.

SUMMARY OF THE INVENTION

Accordingly, a primary object of the present invention is to provide an athletic footwear for non-contact or light-contact sports in which the design criterion reflected in the construction of the shoe tends to maximize the maneuverability of the wearer's foot while at the same time reinforcing the foot against sprains or other natural adversities.

The foregoing object and advantages of my invention are realized in an athletic shoe comprising a resilient sole which both protects the sole portion of the user's foot while at the same time enhancing his traction by reason of a friction tread surface. To the resilient (i.e. by definition: elastic) sole are attached a forward and a rear upper portion, each of which is strategically positioned to reinforce the foot of the wearer at the points of maximum foot flexibility namely, across the ball of the foot and across the ankle. In addition to serving the function of means for attaching the shoe to the wearer's foot, the front and rear upper portions also serve to reinforce the maximum stress points of the foot. Limiting the upper portions of the shoe to just these two areas permits relative isolation of the ankle with respect to the ball of the foot. This attribute complements that which the foot has inherited from nature, the latter being thus preserved in the design of my footwear.

This means that while the wearer is engaging in movements requiring maximum mobility, as for example when the user decides to turn while in the act of thrusting forward, the stresses thus placed on the ankle and which are in turn transmitted to the rear upper portion of the shoe will not be interferingly communicated to the ball of the foot via the front upper portion of the shoe such as would occur in an athletic shoe of conventional design by reason of the interconnecting fabric portion not found in applicant's shoe structure. Thus, in the aforementioned example wherein the wearer, while engaged in moving forward, decides to execute a sharp turn, he must, upon planting his foot, pivot on the ball thereof while the ankle absorbs the momentum from the previously initiated forward thrust. A person who executes this movement while wearing my footwear will find that the rear upper portion of the shoe independently reinforces the wearer's ankle while the upper front portion reinforces the ball of the foot. While this is but a single example of the isolated reinforcement achieved by reason of the design of my novel footwear, it serves to establish the significance of the principle of my novel design which is also exhibited in other combinatorial movements in which the ankle and ball of the foot move rather independently.

Another design feature which tends to enhance the performance of my athletic shoe concerns the placement of the front upper portion of the shoe relative to the ball of the wearer's foot. In the preferred embodiment of the present invention, the front upper portion is located forward of where it would be found in an athletic shoe of conventional design. Thus, consider that approximately 1½ inches of the forward portion of a conventional athletic shoe has been removed and that the balance is coextensive in length to that of a user's normal athletic footwear. If the user were to then place his foot within the altered footwear of my design he would find that while his toes were exposed, they nevertheless would be protected against stubbing by reason of the sole which is generally coextensive therewith. Of greater significance is the fact that when the laces are drawn up the wearer's foot will be restrained from shifting forward more so than were his foot constrained by unaltered footwear. Since the front upper portion restrains the wearer's foot forward of where a conventional athletic shoe would act there will in effect be a lesser forward shifting of the foot in the subject footwear upon sudden stops or dramatic changes in speed or direction. The absence of any toe portion in the athletic shoe will also preclude the large toe from shifting forward and rubbing up against the end portion such as is common in athletic shoes of conventional design.

An attempt has been made here to effectively isolate the upper portion of an athletic shoe to thereby preclude any interference between the front and rear upper portions thereof thus duplicating insofar as possible the natural isolation of the ball and ankle of the foot. While this is true in nature, it is also true that these two portions of the foot are joined together by tendons running essentially parallel with the line of the leg and the foot. By using a single lace to draw up both the forward and rear upper portions of the applicant's athletic shoe, this latter characteristic of nature is effectively reinforced. While the use of a single lace will, in effect, result in the transmittal of forces from the front upper portion of the shoe to the rear upper portion of the shoe, and vice versa as a result of independent movement of the ankle and/or ball of the foot, these forces will in effect simply reinforce any restraining forces being transmitted therebetween via the tendons of the foot. If, because of the cut of the shoe or the stresses involved, restraining effects between the front and rear upper portions are noted, it is possible to employ individual laces, using one each in the front and rear upper portions.

Further objects and advantages of my invention will become more readily apparent upon reference to the accompanying drawings which illustrate a preferred embodiment of an athletic shoe incorporating the features of my invention.

IN THE DRAWINGS

DETAILED DESCRIPTION OF THE INVENTION

Figure 1:
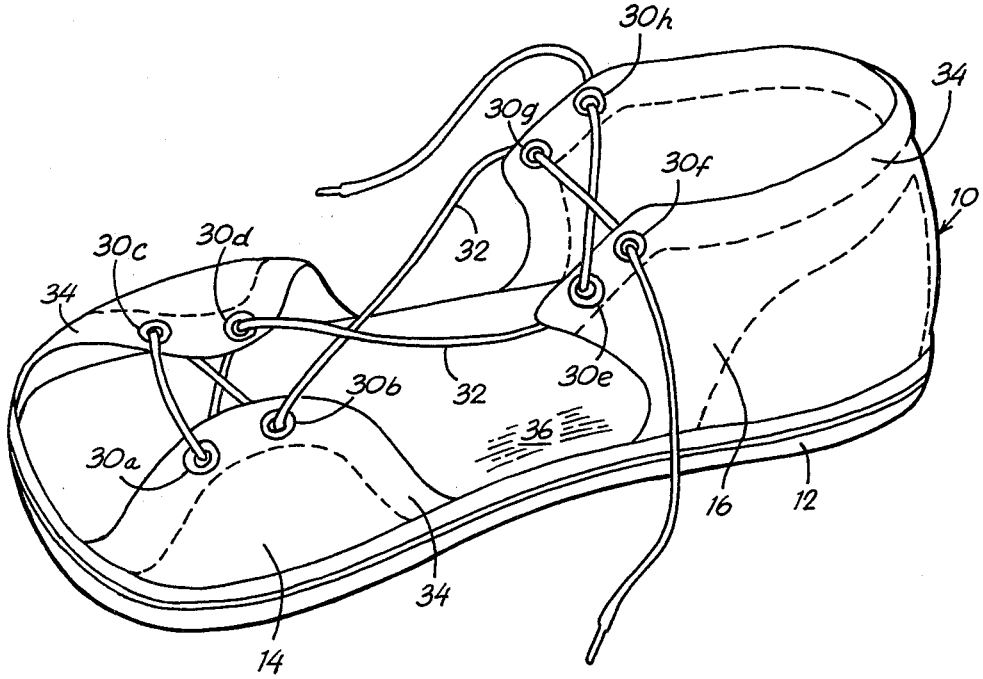
FIG. 1 is a perspective view of athletic footwear embodying the present invention.
Figure 2:
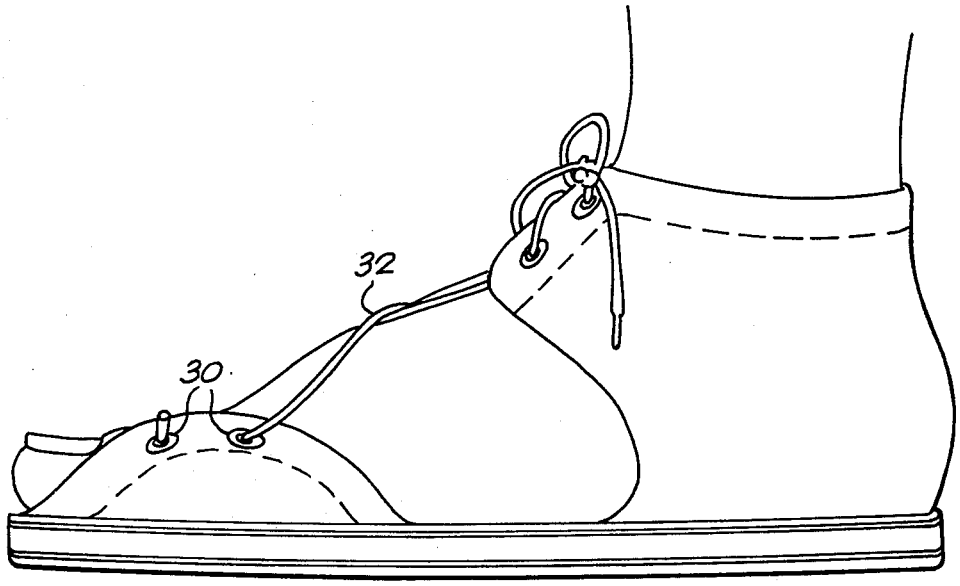
FIG. 2 is a side elevation of the athletic footwear illustrated in FIG. 1, illustrating a user's foot positioned in conjunction therewith; and, FIGS. 3A and 3B comprise partial sectional views of the athletic footwear illustrated in FIG. 1.

As shown in FIG. 1, the athletic shoe generally designated as member 10 comprises a sole portion 12 of rubber or other suitable flexible resilient material secured to fabric front and rear upper portions 14 and 16 respectively. The fabric uppers 14 and 16 are preferably of a multi-ply canvas of the type well known in the athletic footwear industry; however, in an alternative embodiment of the present invention the entire shoe is comprised of rubber molded material.

Figure 3B:
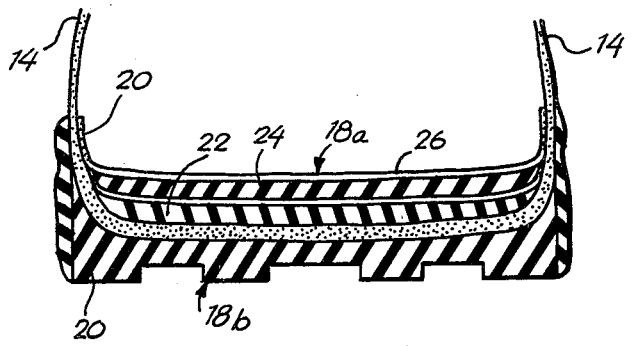
Figure 3A:
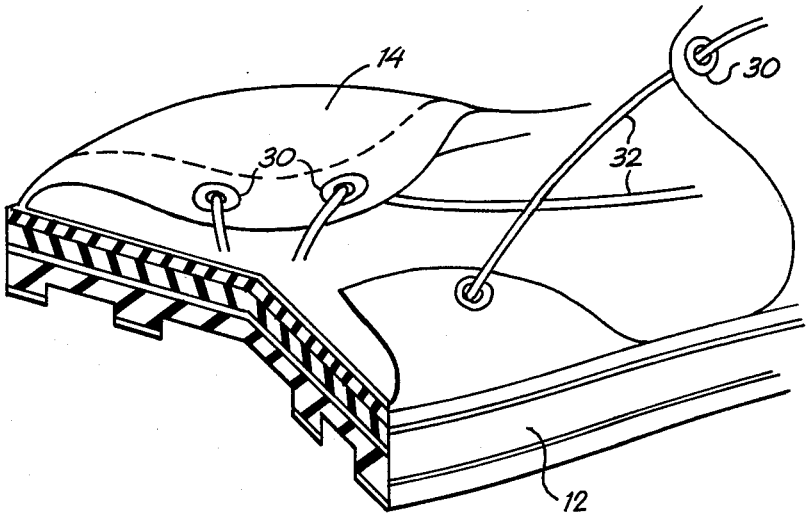

The uppers 14 and 16 are securely fastened to the sole portion 12 in a conventional manner which may be seen upon reference to FIGS. 3A and 3B wherein the sole 12 is seen as comprising a hard rubber member being somewhat concave on its upper surface 18*a* and treaded on its lower surface 18*b* to provide suitable foot traction to the user. A layer of canvas material 20 is sandwiched between the outer sole 18 and a hard rubber filler 22. The canvas 20 extends beyond the periphery of the filler 22 and the outer sole 18 in locations proximate to the front and rear upper portions, the latter being secured to the projecting portions of the canvas 20 by suitable means such as stitching. The filler 22 is overlayed with a thin cushioning layer of foam 24 which, together with a protective covering such as canvas 26 forms an innersole. A protective trim strip 28 preferably of rubber or other suitable plastic material is suitably attached by vulcanization or other means to the periphery of the outer sole 18 after the front and rear upper portions have been attached. The filler 22, foam 24, and canvas 26 comprise an innersole 36 which is configured to insure that the user's foot is comfortably but securely positioned within the footwear 10 and for this purpose is built-up in the area of the instep so as to provide a cushioned pad to support the wearer's arch.

Although the construction details of the sole 12 and the details for attaching the sole to the uppers 14 and 16 do not comprise part of the present invention the readily yieldable elastic nature which characterizes such sole construction when coupled to the design characteristics of the upper portion of the subject athletic footwear affords maximized maneuverability to the wearer, as alluded to above. The construction details of the sole portion have been illustrated in detail in FIGS. 3A and 3B for teaching purposes.

The tabular portions of the front and rear uppers 14 and 16 each have two bosses 30 sewn thereto for purposes of reinforcing the fabric material at the points where the lacing member 32 induces maximum stress. In addition to the bosses 30, the uppers 14 and 16 have been selectively reinforced by members 34 to distribute the stress load uniformly over the footwear. The bosses 30 and reinforcing material 34 are preferably of soft leather thus protecting the wearer from irritation in situations where the footwear is worn without socks.

As has already been pointed out, the subject footwear is designed to assimilate the unusually large stresses to which a user's foot is subjected while the wearer is engaging in sports activities. By providing two isolated uppers, each of which functions at a point of maximum foot flexure, my design insures that the stresses introduced at one such flexure point are not adversely transmitted to the other such flexure points. In this manner, the wearer receives reinforcement at the points of maximum stress without encountering potentially harmful interference.

An added advantage resulting from the relatively light weight of my footwear is that it helps to preserve the staying power of the user. This makes it practical to use footwear of my design in situations which normally preclude such use, such as in connection with water sports. Thus, my footwear can be comfortably worn while the user is engaging in water sports, such as wading and snorkeling, where mobility as well as foot protection are desirable but not provided by conventional footwear because of their tendency to trap water which thus constitutes a drag on the user. Flippers are not normally serviceable for such use because of their clumsiness when an attempt is made to walk with them on land or in shallow water.

As has been pointed out above, the design characteristics of my footwear, including its flexibility, lightweight, and reinforcement at the critical points of the foot, enhance its use in non-contact or light-contact sports such as badminton, tennis, track, and even in more relaxed games of volleyball and basketball. In addition, my footwear serves as a good casual shoe, particularly in hot climates, because of the good ventilation to the foot afforded by its design.

While particular advantages and features of my design have been stressed in this explanation, it should be apparent to those skilled in the art that other changes and modifications may be made therein without material departure from the spirit and scope of the appended claims.

What I claim is:

1. An athletic shoe characterized by members which are in contact with and which reinforce the wearer's foot at points of maximum flexibility only and which athletic shoe is otherwise unrestricting as to the wearer's foot, comprising first means to protect the sole of the wearer's foot from direct contact with a playing surface, said first means comprising a readily yieldable elastic sole portion member extending essentially the entire length and width of the wearer's foot and conforming to the natural configuration of the sole of said foot; second and third means independently attached to said first means, said second means further comprising two generally tabular shaped members configured to restrainedly encompass the wearer around the ankle and remain in close restraining relationship therewith to thereby reinforce and protect the maximum stress points of the wearer's ankle whereby said first and second means acting in conjunction with one another to minimize any shifting of the heel of the wearer relative to said first means while permitting the wearer to move the ankle in a manner which is independent of and unconstrained by said third means, and said third means further comprising two generally tabular shaped members configured to restrainedly encompass the wearer only above the ball of the foot and remain in close restraining relationship therewith so as to thereby reinforce and protect said ball of the foot whereby said first and third means acting in conjunction with one another permit the wearer's foot to flex across the ball portion thereof in a manner which is independent of and unconstrained by said second means while precluding the foot from shifting forward relative to said first means.

2. The athletic shoe of claim 1 wherein said second and third means are comprised of reinforced canvas material.

3. The athletic shoe of claim 1 wherein said second and third means are comprised of rubber material.

4. The athletic shoe of claim 1 wherein a single lacing member is used to draw up said said second and third means.

* * * * *